US011202481B2

(12) United States Patent
Olivas

(10) Patent No.: US 11,202,481 B2
(45) Date of Patent: Dec. 21, 2021

(54) ILLUMINATING DEVICE FOR SPORTS HELMET EYE SHIELD

(71) Applicant: Gianni Olivas, San Bernardino, CA (US)

(72) Inventor: Gianni Olivas, San Bernardino, CA (US)

( * ) Notice: Subject to any disclaimer, the term of this patent is extended or adjusted under 35 U.S.C. 154(b) by 0 days.

(21) Appl. No.: 17/173,948

(22) Filed: Feb. 11, 2021

(65) Prior Publication Data

US 2021/0244121 A1 Aug. 12, 2021

Related U.S. Application Data

(60) Provisional application No. 62/972,741, filed on Feb. 11, 2020.

(51) Int. Cl.

| | |
|---|---|
| ***F21S 4/28*** | (2016.01) |
| ***A42B 3/04*** | (2006.01) |
| ***F21V 23/04*** | (2006.01) |
| ***F21V 23/06*** | (2006.01) |
| ***F21S 9/02*** | (2006.01) |
| *F21Y 115/10* | (2016.01) |

(52) U.S. Cl.

CPC ..... *A42B 3/044* (2013.01); *F21S 4/28* (2016.01); *F21S 9/02* (2013.01); *F21V 23/04* (2013.01); *F21V 23/06* (2013.01); *F21Y 2115/10* (2016.08)

(58) Field of Classification Search

CPC .... F21S 4/28; F21S 9/02; F21V 23/04; F21V 23/06; F21Y 2115/10

See application file for complete search history.

(56) References Cited

U.S. PATENT DOCUMENTS

| | | | | |
|---|---|---|---|---|
| 6,113,243 | A * | 9/2000 | Saul | A42B 3/0453 345/8 |
| 7,341,361 | B2 * | 3/2008 | Gagne | A62B 18/08 2/906 |
| 2005/0099799 | A1 * | 5/2005 | Cugini | G02C 11/04 362/105 |
| 2006/0232955 | A1 * | 10/2006 | Labine | A42B 3/044 362/105 |
| 2014/0111977 | A1 * | 4/2014 | Nyberg | A41D 13/1184 362/105 |

* cited by examiner

*Primary Examiner* — Evan P Dzierzynski

(57) ABSTRACT

An Illuminating device for sports helmet eye shield includes a housing, an eye shield attachment, a light-emitting diode (LED) strip, a chipset, a rechargeable battery, and a plurality of control buttons. The housing includes a lateral wall, a rear plate, and a front opening. The lateral wall is perimetrically connected around the rear plate. The front opening is delineated within the lateral wall. The eye shield attachment is connected onto an outer plate of the lateral wall. The LED strip is perimetrically connected to the lateral wall through the front opening. The chipset and the rechargeable battery are internally mounted to the housing. The control buttons are externally connected to an inner plate of the lateral wall. The LED strip, the control buttons, and the chipset are electrically connected to the rechargeable battery. The LED strip and the control buttons are electronically connected to the chipset.

10 Claims, 8 Drawing Sheets

ILLUMINATING DEVICE FOR SPORTS HELMET EYE SHIELD

FIELD OF THE INVENTION

The present invention relates to sports helmet. More specifically, the present invention is an illuminating device for sports helmet the eye shield so that the eye shield of the sports helmet can be illuminated to provide an aesthetically pleasing appearance without distracting the wearer of the sports helmet.

BACKGROUND OF THE INVENTION

Sport equipment come in many different shape and sizes along with different designs to aesthetically please for both the users and spectators. However, simple designs and patterns are reappearing in different positions and arrangements are nearly getting repetitive. Having a new types of design and/or décor aesthetically pleasing compared to other simple designs and patterns. There are many different sports equipment with many different designs and patterns in the market today as the aforementioned designs and patterns are simply printed on the sports equipment. Resultantly, an innovative way to design and/or décor sports equipment is required element within the current sporting market.

An objective of the present invention is to provide users a unique way to design and/or décor sports helmet. More specifically, the present invention is an illuminating device for sports helmet the eye shield that provides a light-emitting diode display on the eye shield of any sports helmet of the user. The present invention can be removably mounted to the sports helmet through an eye shield attachment. The present invention furthermore provides a way of design and control the light-emitting diode display according to the user's personal preference.

DETAIL DESCRIPTIONS OF THE INVENTION

Figure 1:
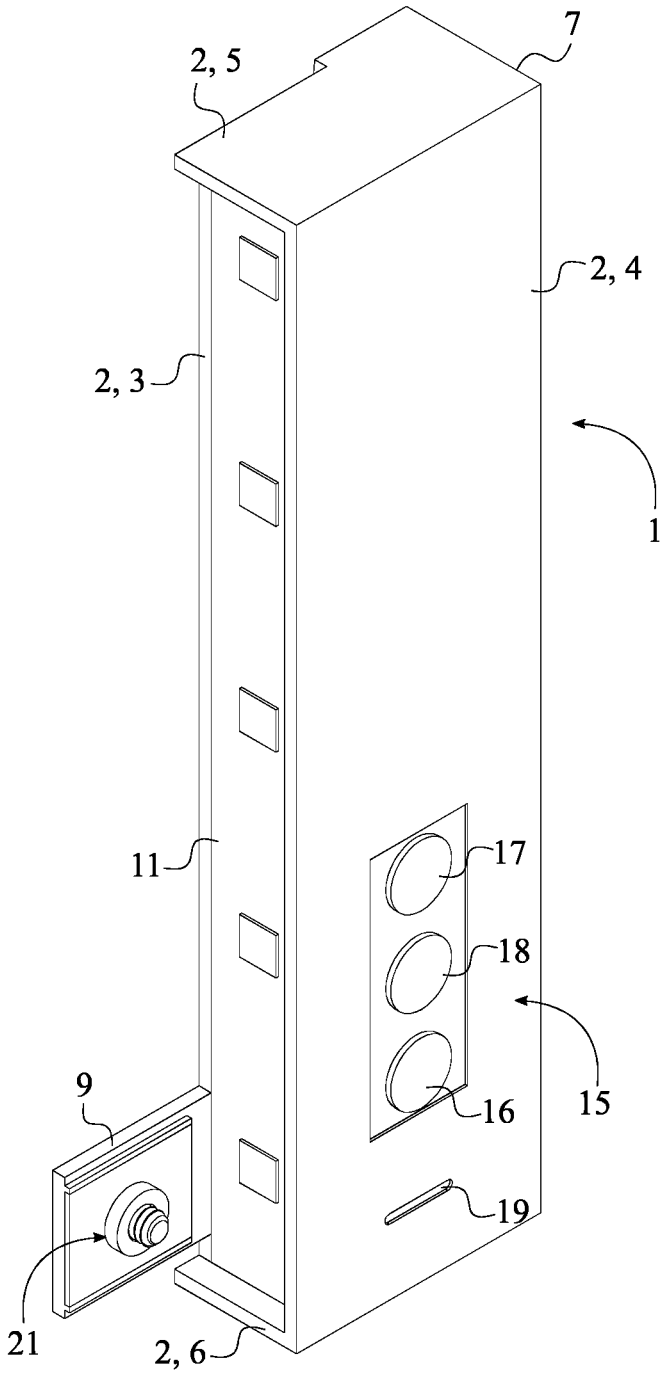
FIG. 1 is a front perspective view of the present invention.

All illustrations of the drawings are for the purpose of describing selected versions of the present invention and are not intended to limit the scope of the present invention.

The present invention is an illuminating device for sports helmet eye shield so that the eye shield area can be illuminated to provide an aesthetically pleasing appearance without distracting the wearer of the sports helmet. The illuminating spectrum, design, and features of the present invention can be controlled according to the user's personal preference. The present invention comprises a housing 1, an eye shield attachment 9, a light-emitting diode (LED) strip 11, a chipset 12, a rechargeable battery 13, and a plurality of control buttons 15 as shown in FIG. 1-5. The housing 1 functions as the main structural body within the present invention and comprises a lateral wall 2, a rear plate 7, and a front opening 8.

Figure 7:
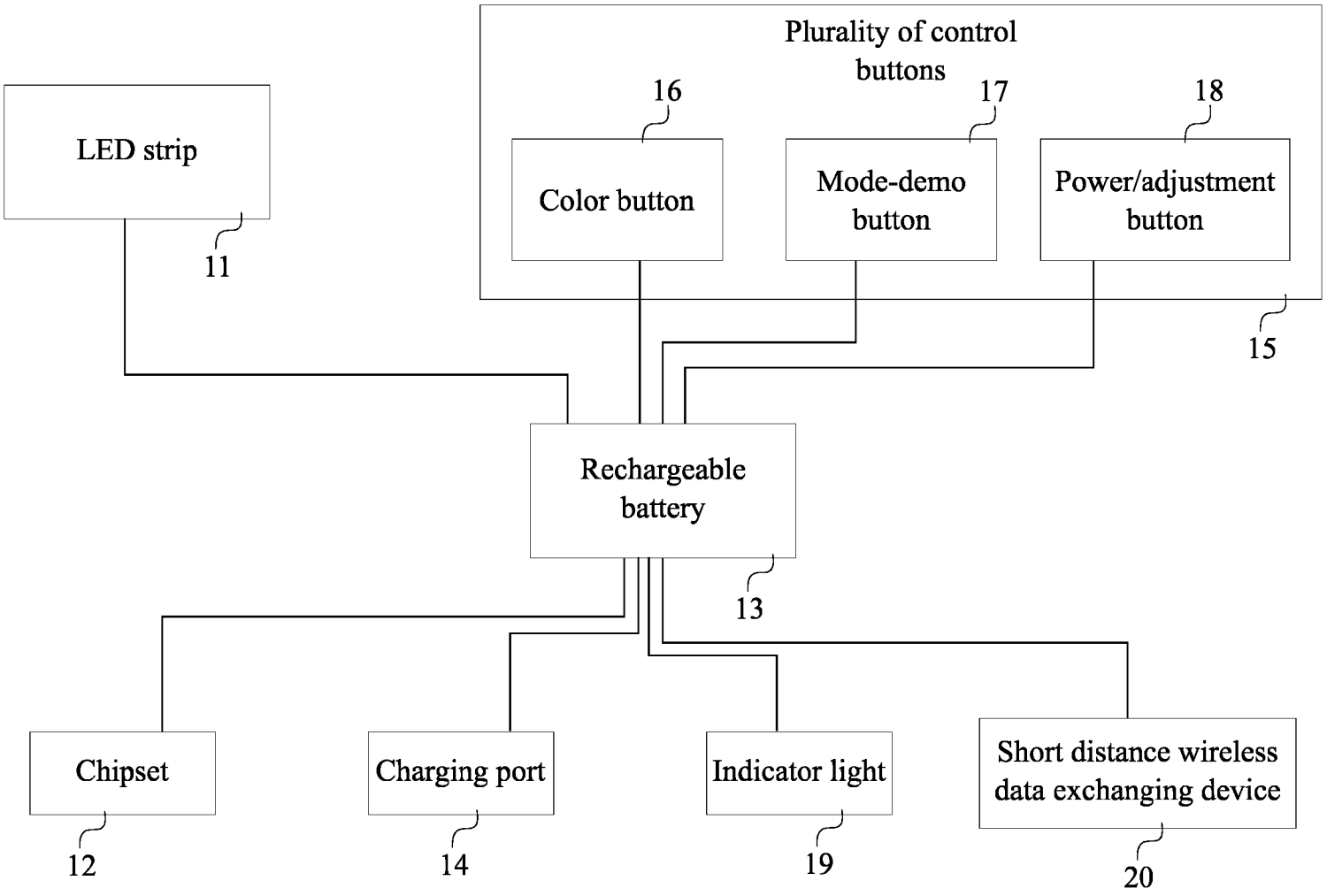
FIG. 7 is a basic schematic view showing the electrical connections of the present invention.
Figure 8:
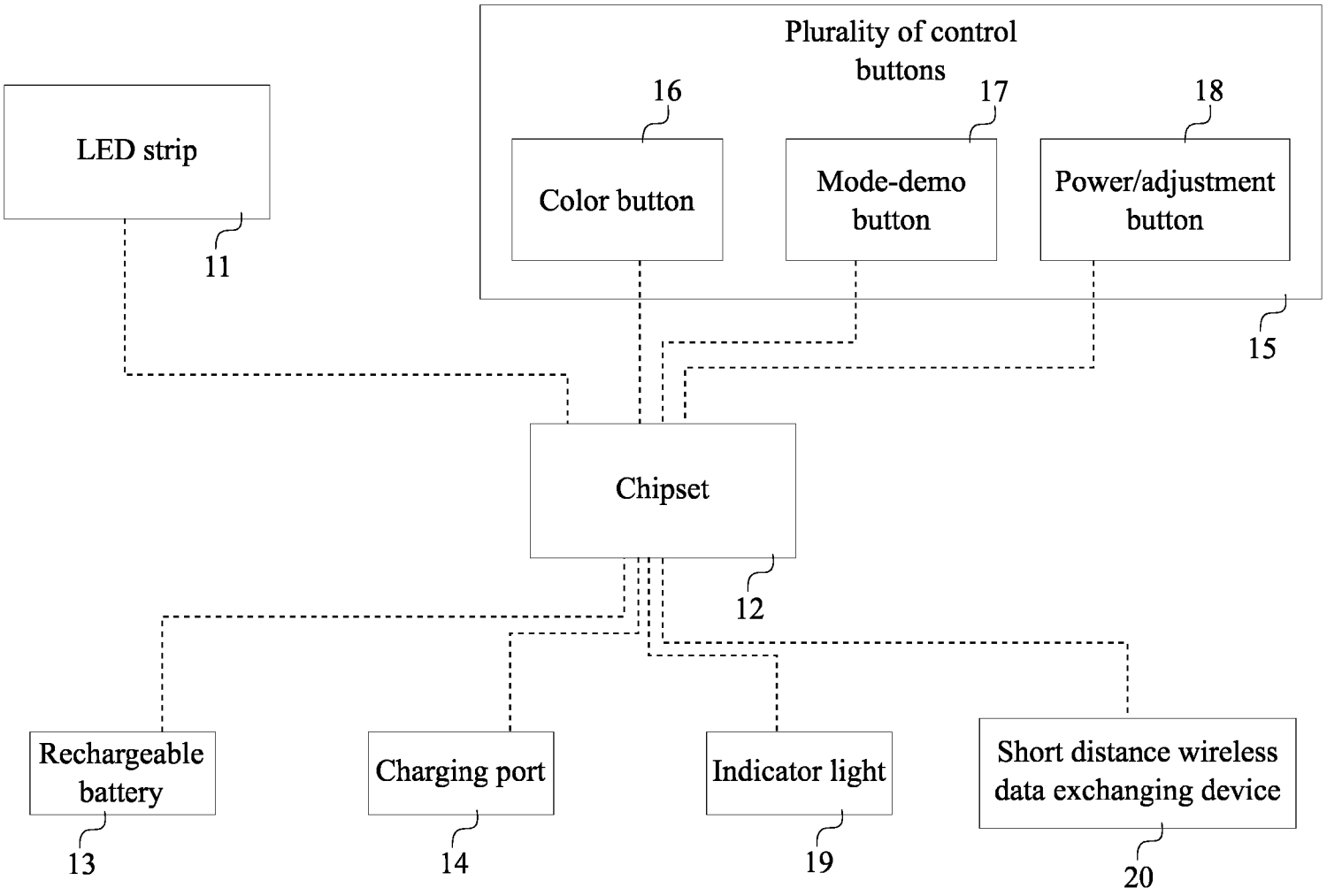
FIG. 8 is a basic schematic view showing the electronic connections of the present invention.

In reference to the general configuration of the present invention, the lateral wall 2 is perimetrically connected around the rear plate 7 so that the housing 1 can be formed into a rectangular shaped structure. The front opening 8 is delineated within the lateral wall 2 and oppositely positioned of the rear plate 7 so that the internal space of the housing 1 can be accessed through the front opening 8. The eye shield attachment 9 is connected onto an outer plate 3 of the lateral wall 2 and functions thus enabling the present invention to be mounted to the sports helmet. The LED strip 11 is perimetrically connected to the lateral wall 2 through the front opening 8 and functions as the illuminating device. The chipset 12 and the rechargeable battery 13 are internally mounted to the housing 1 protected through the rear plate 7, the lateral wall 2, and the LED strip 11. The plurality of control buttons 15 are externally connected to an inner plate 4 of the lateral wall 2 so the user is able to control the illuminating features of the present invention. In order to electrically power the present invention, the LED strip 11, the plurality of control buttons 15, and the chipset 12 are electrically connected to the rechargeable battery 13 as shown in FIG. 7. Furthermore, the LED strip 11, the plurality of control buttons 15, and the rechargeable battery 13 are electronically connected to the chipset 12 thus allowing the chipset 12 to control illuminating features of the present invention through the input commands of the plurality of control buttons 15 as shown in FIG. 8.

In reference to FIG. 1-5, the housing 1 functions as the main structural body so that the rest of the components of the present invention can be mounted and connected onto the housing 1. The lateral wall 2 further comprising a top plate 5 and a bottom plate 6 in addition to the inner plate 4 and the outer plate 3 defining the four lateral plates of the housing 1. More specifically, the top plate 5 and the bottom plate 6 are oppositely positioned of each other about the lateral wall 2. The outer plate 3 and the inner plate 4 are oppositely positioned of each other about the lateral wall 2. The top plate 5 is perpendicularly positioned to the outer plate 3 and the inner plate 4. The bottom plate 6 is perpendicularly positioned to the outer plate 3 and the inner plate 4. The outer plate 3 and the inner plate 4 are terminally connected to each other by the top plate 5 and the bottom plate 6, wherein the lateral wall 2 defines the depth of the housing 1. The rear plate 7 is perimetrically connected to the top plate 5, the bottom plate 6, the outer plate 3, and the inner plate 4 as the front opening 8 is delineated within the top plate 5, the bottom plate 6, the outer plate 3, and the inner plate 4.

Figure 2:
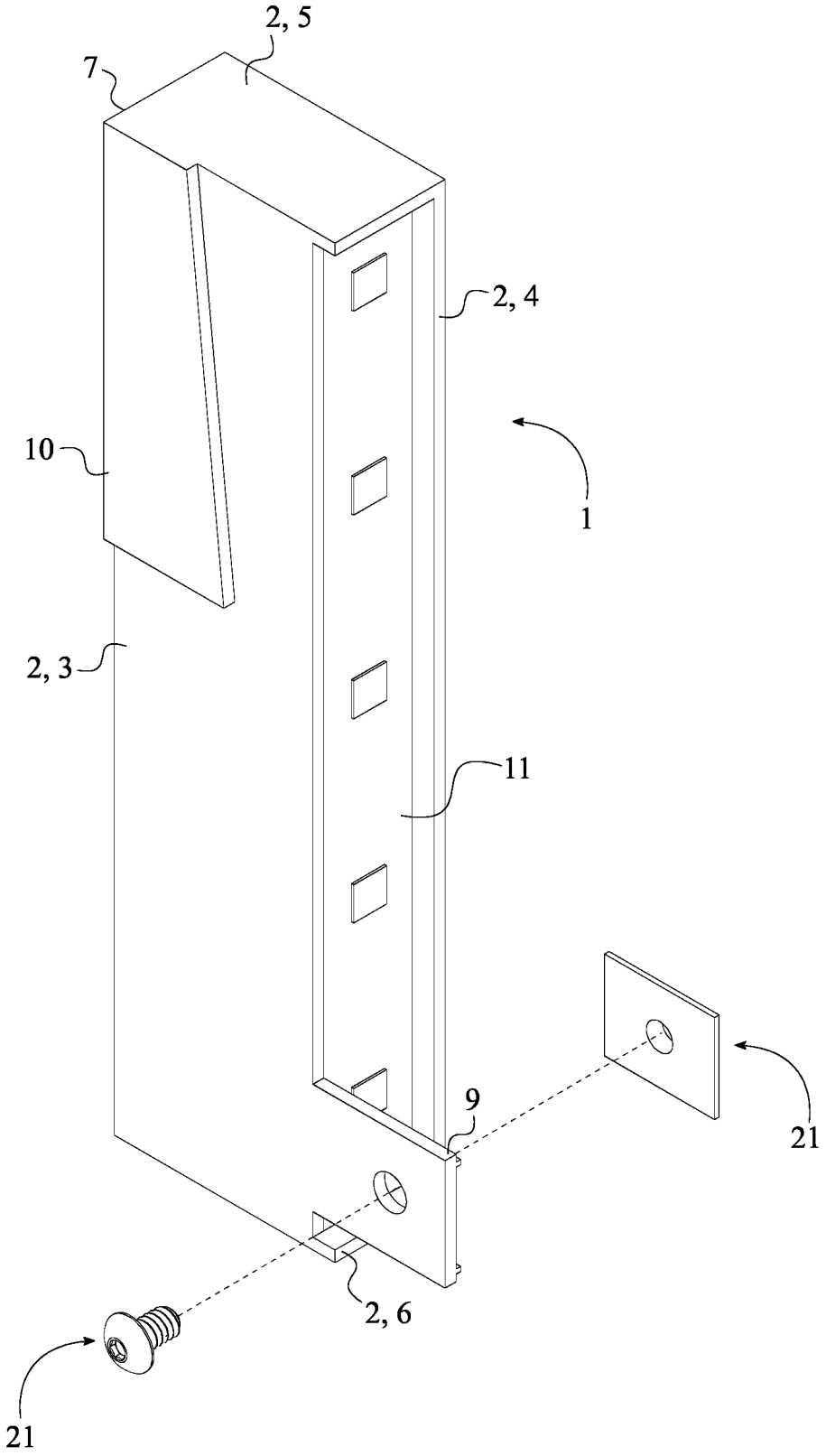
FIG. 2 is another front perspective view of the present invention, wherein the fastening mechanism is in an exploded view.
Figure 3:
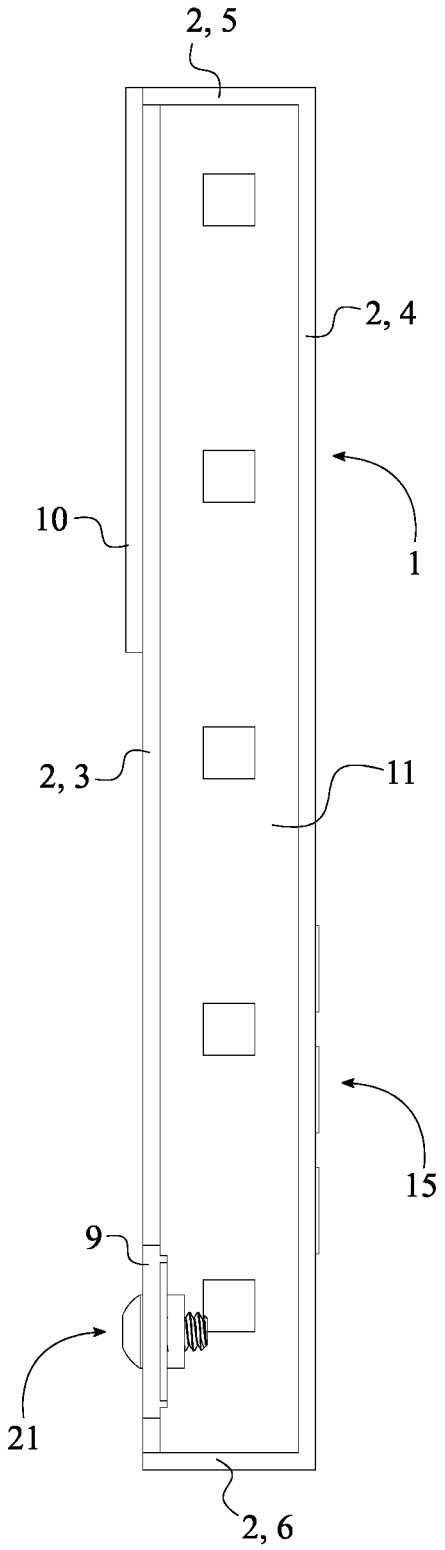
FIG. 3 is a front view of the present invention.

In reference to FIG. 1-3, the LED strip 11 is internally connected to the top plate 5, the bottom plate 6, the outer plate 3, and the inner plate 4 via the front opening 8. As a result, the LED strip 11 is able to functions as the illuminating device within the present invention. Furthermore, the LED strip 11 also functions as a cover for the housing 1 so that the internally mounted components such as chipset 12 and rechargeable battery 13 can be protected from outside elements. Once the present invention is mounted the sports helmet, the LED strip 11 is oriented toward the eye shield of the helmet to project the illumination features. The LED strip 11 is also capable of performing any possible color combinations of the LED (ex: red, green, blue, white, etc.).

In reference to FIG. 2, the present invention further comprises an alignment ridge 10 to precisely align the housing 1 to the eye shield. Depending upon different eye shield of different sports helmet, the structural shape of the alignment ridge 10 can be altered. More specifically, the alignment ridge 10 is positioned flush with the rear plate 7 and the top plate 5 as the alignment ridge 10 is connected onto the outer plate 3. In the preferred embodiment of the present invention, the alignment ridge 10 is designed to fit within an existing gap between a free end of the eye shield and a shell of the football helmet. As explained before, the structural shape of the alignment ridge 10 can be different when the alignment ridge 10 is designed to fit within an existing gap between a free end of the eye shield and the ice hockey helmet.

In reference to FIG. 1-3, the eye shield attachment 9 that mounts the housing 1 to the sports helmet is positioned adjacent to the bottom plate 6 and outwardly extended from the outer plate 3. In the preferred embodiment of the present invention, the eye shield attachment 9 is designed to be mount to a facemask of the football helmet. Due to the positioning of the eye shield attachment 9 adjacent to the bottom plate 6, the housing 1 is able to generally position in an upright orientation and adjacent a vision field of the facemask. Depending upon different embodiments of the present invention, placement of the eye shield attachment 9 can differ to accommodate different helmets such as hokey, baseball, cricket, and other similar types of helmets.

In reference to FIG. 1-2, the present invention further comprises a fastening mechanism 21 so that the eye shield attachment 9 can be attached to the sports helmet. In the preferred embodiment of the present invention, the fastening mechanism 21 is integrated onto the eye shield attachment 9 and comprises a bolt fastener and a nut fastener. More specifically, an opening of the eye shield attachment 9 is concentrically aligned with a shield mounting clip opening so that the bolt fastener can be traversed through the opening of the eye shield and the shield mounting clip opening from outside. Then, the nut fastener is stationarily placed against the eye shield attachment 9 from inside thus allowing the bolt fastener to threadedly engaged with the nut fastener. However, the present invention is not limited to the bolt/nut fasteners and can utilize other type of fasteners such as adhesive strips, magnetic fasteners, clip fasteners, and friction fit fasteners as the fastening mechanism 21.

Figure 4:
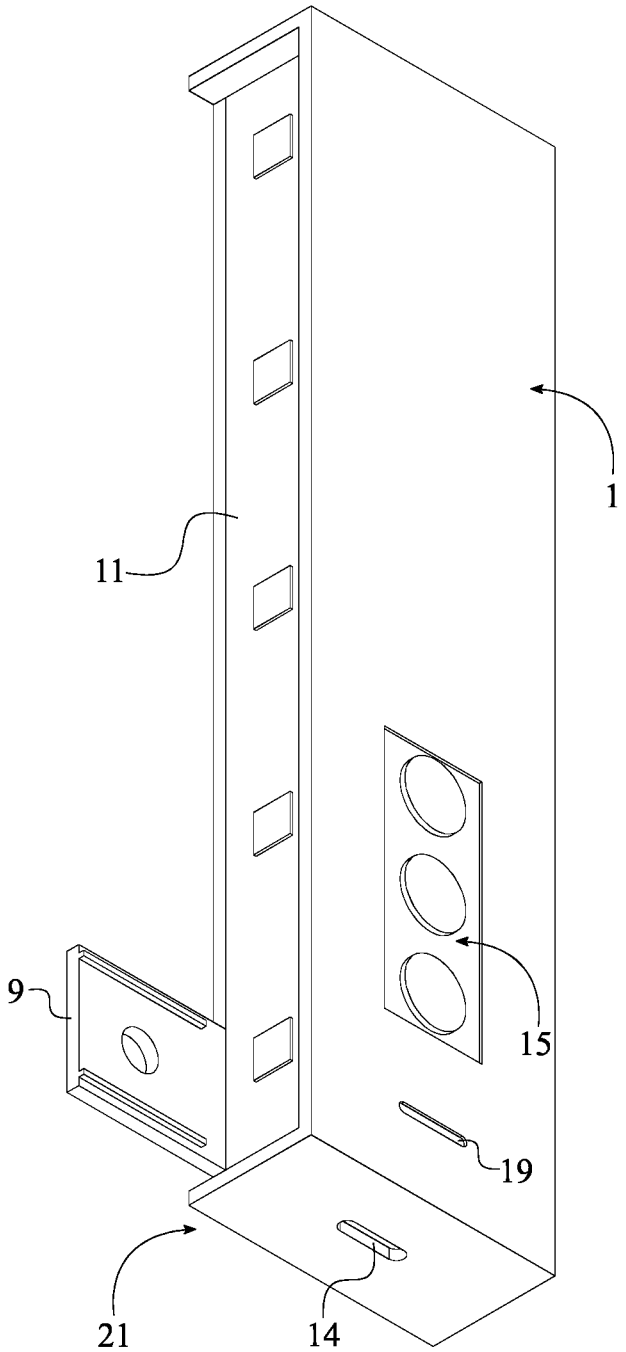
FIG. 4 is a bottom perspective view of the present invention without the fastening mechanism.

In reference to FIG. 4 and FIG. 7-8, the present invention further comprises a charging port 14 that is integrated onto the housing 1. More specifically, the charging port 14 is electrically connected to the rechargeable battery 13 so that an external power source can charge the rechargeable battery 13. The charging port 14 is electronically connected to the chipset 12 so that the chipset 12 is able to prevent overcharging of the rechargeable battery 13. The charging port 14 is preferably a micro universal serial bus charging port 14; however, the present invention can use any other type of power inputs that can charge the rechargeable battery 13 as the charging port 14.

In reference to FIG. 4 and FIG. 7-8, the present invention further comprises an indicator light 19. More specifically, the indicator light 19 is integrated onto the housing 1 so that the user can easily see the illumination of the indicator light 19. The indicator light 19 is electrically connected to the rechargeable battery 13 so that the indicator light 19 can be electrically powered. The indicator light 19 is electronically connected to the chipset 12 in order to visually inform the user that the charging cycle for the rechargeable battery 13 is completed or not. For example, when an external power source is charging the rechargeable battery 13, the indicator light 19 maintains an illuminating status to inform the user. Once the charging cycle for the rechargeable battery 13 is completed, the indicator light 19 switches into a non-illuminating status to inform the user.

Figure 5:
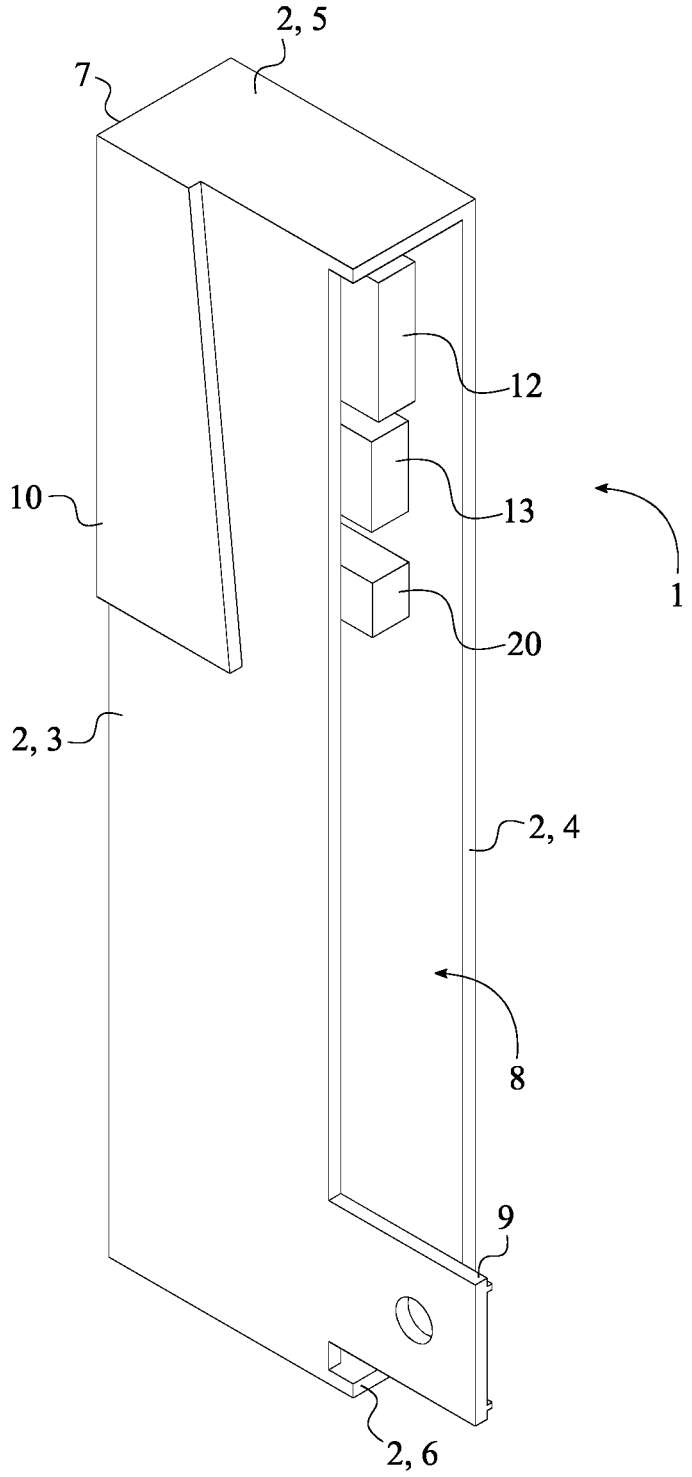
FIG. 5 is a perspective view of the present invention without the fastening mechanism and the LED strip, showing the inside of the housing.

In reference to FIG. 5 and FIG. 7-8, the present invention further comprises a short distance wireless data exchanging device 20. More specifically, the short distance wireless data exchanging device 20 is internally mounted to the housing 1. The short distance wireless data exchanging device 20 is electrically connected to the rechargeable battery 13 so that the short distance wireless data exchanging device 20 can be electrically powered. The short distance wireless data exchanging device 20 is electronically connected to the chipset 12 in order to control the illuminating features of the present invention to be control from an external computing device via a software application. In other words, the external computing device is able to remotely execute the functionality of the plurality of control buttons 15 through the short distance wireless data exchanging device 20.

In reference to FIG. 1 and FIG. 7-8, the plurality of control buttons 15 comprises a color button 16, a mode/demo button 17, and a power/adjustment button 18 so that the illuminating features of the present invention can be controlled. More specifically, the color button 16, the mode/demo button 17, and the power/adjustment button 18 are electrically connected to the rechargeable battery 13 so that each of the plurality of control buttons 15 can be electrically powered. The color button 16, the mode/demo button 17, and the power/adjustment button 18 being electronically connected to the chipset 12 in order to electronically transfer the input commands of each of the plurality of control buttons 15 into the LED strip 11. For example, the power/adjustment button 18 allows the user to turn-on and turn-off the present invention and adjust the brightness of the LED strip 11. The user can change the color of the LED strip 11 by pressing the color button 16. The mode/demo button 17*s* enables the user to switch between a blinking mode and a blending mode. The user can easily switch to solid color mode by pressing the color button 16.

Figure 6:
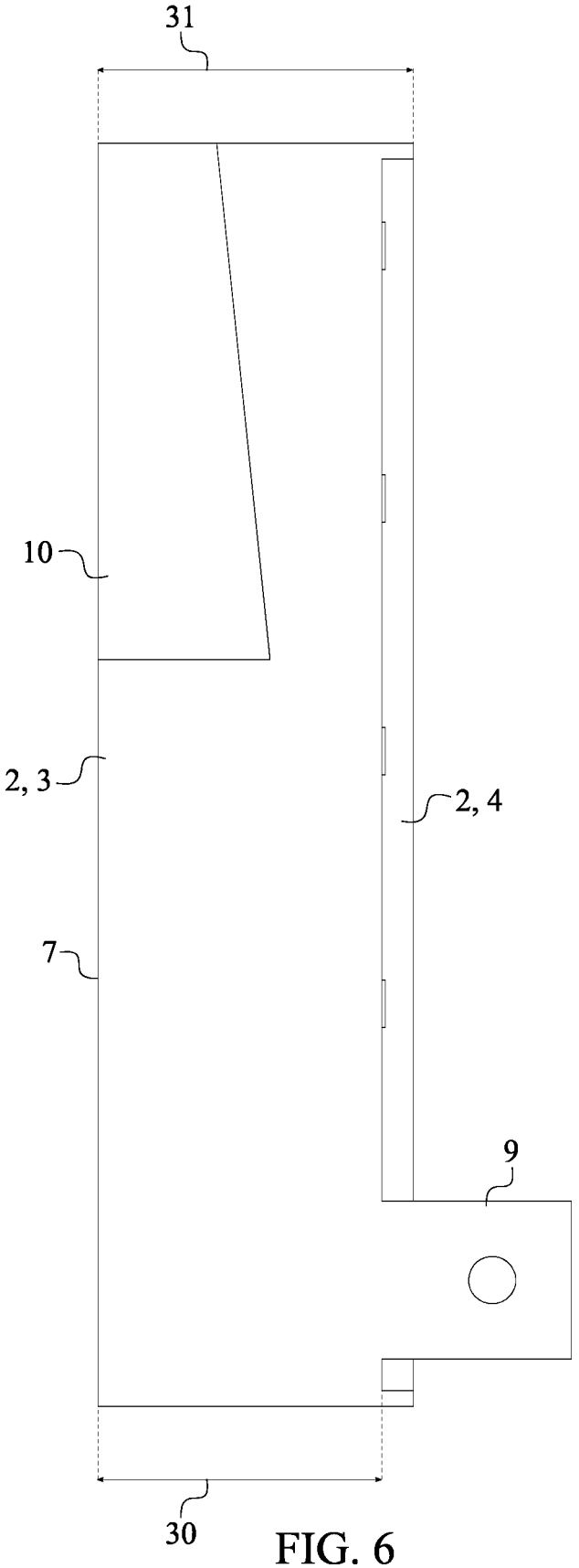
FIG. 6 is a side view of the present invention showing the depth difference between the inner plate and the outer plate.

In reference to FIG. 6, a depth 31 of the inner plate 4 is larger than a depth 30 of the outer plate 3 to block out the illuminating features of the LED strip 11. More specifically, The LED strip 11 is positioned flush with a free end of the outer plate 3 and offset from a free end of the inner plate 4, wherein the free end of the inner plate 4 is outwardly extended from the LED strip 11. As a result, the vision field for the wearer of the sports helmet can be unobstructed from the illuminating features of the present invention.

In a preferred configuration of the present invention, a pair of illuminating devices are mounted to a left end and a right end of the eye shield to fully illuminate the sports helmet eye shield. In some embodiment of the present invention, three illuminating devices can be mounted to a top-left end, a top-right end, and along the bottom edge of the eye shield to fully illuminate the sports helmet eye shield. In some embodiment of the present invention, at least one illuminating device can be pre-manufactured into the eye shield.

Although the invention has been explained in relation to its preferred embodiment, it is to be understood that many other possible modifications and variations can be made without departing from the spirit and scope of the invention as hereinafter claimed.

What is claimed is:

1. An Illuminating device for sports helmet eye shield comprising:

a housing;
an eye shield attachment;
a light-emitting diode (LED) strip;
a chipset;
a rechargeable battery;
a plurality of control buttons;
the housing comprising a lateral wall, a rear plate, and a front opening;
the lateral wall being perimetrically connected around the rear plate;
the front opening being delineated within the lateral wall;
the eye shield attachment being connected onto an outer plate of the lateral wall;
the LED strip being perimetrically connected to the lateral wall through the front opening;
the chipset and the rechargeable battery being internally mounted to the housing;
the plurality of control buttons being externally connected to an inner plate of the lateral wall;
the LED strip, the plurality of control buttons, and the chipset being electrically connected to the rechargeable battery; and
the LED strip, the plurality of control buttons, and the rechargeable battery being electronically connected to the chipset.

2. The Illuminating device for sports helmet eye shield as claimed in claim 1 comprising:
the lateral wall further comprising a top plate and a bottom plate;
the top plate and the bottom plate being oppositely positioned of each other about the lateral wall;
the outer plate and the inner plate being oppositely positioned of each other about the lateral wall;
the top plate being perpendicularly positioned to the outer plate and the inner plate;
the bottom plate being perpendicularly positioned to the outer plate and the inner plate;
the outer plate and the inner plate being terminally connected to each other by the top plate and the bottom plate;
the front opening being delineated within the top plate, the bottom plate, the outer plate, and the inner plate; and
the LED strip being internally connected to the top plate, the bottom plate, the outer plate, and the inner plate.

3. The Illuminating device for sports helmet eye shield as claimed in claim 1 comprising:
an alignment ridge;
the alignment ridge being positioned flush with the rear plate and a top plate of the lateral wall; and
the alignment ridge being connected onto the outer plate.

4. The Illuminating device for sports helmet eye shield as claimed in claim 1 comprising:
the eye shield attachment being positioned adjacent to a bottom plate of the lateral wall; and
the eye shield attachment being outwardly extended from the outer plate.

5. The Illuminating device for sports helmet eye shield as claimed in claim 4 comprising:
a fastening mechanism; and
the fastening mechanism being integrated onto the eye shield attachment.

6. The Illuminating device for sports helmet eye shield as claimed in claim 1 comprising:
a charging port;
the charging port being integrated onto the housing;
the charging port being electrically connected to the rechargeable battery; and
the charging port being electronically connected to the chipset.

7. The Illuminating device for sports helmet eye shield as claimed in claim 1 comprising:
an indicator light;
the indicator light being integrated onto the housing;
the indicator light being electrically connected to the rechargeable battery; and
the indicator light being electronically connected to the chipset.

8. The Illuminating device for sports helmet eye shield as claimed in claim 1 comprising:
a short distance wireless data exchanging device;
the short distance wireless data exchanging device being internally mounted to the housing;
the short distance wireless data exchanging device being electrically connected to the rechargeable battery; and
the short distance wireless data exchanging device being electronically connected to the chipset.

9. The Illuminating device for sports helmet eye shield as claimed in claim 1 comprising:
the plurality of control buttons comprising a color button, a mode/demo button, and a power/adjustment button;
the color button, the mode/demo button, and the power/adjustment button being electrically connected to the rechargeable battery; and
the color button, the mode/demo button, and the power/adjustment button being electronically connected to the chipset.

10. The Illuminating device for sports helmet eye shield as claimed in claim 1, wherein a depth of the inner plate is larger than a depth of the outer plate.

* * * * *